US011648652B2

(12) United States Patent
Cai

(10) Patent No.: US 11,648,652 B2
(45) Date of Patent: May 16, 2023

(54) NAILING DEPTH ADJUSTABLE AIR NAIL GUN

(71) Applicant: Shengyong Cai, Zhejiang (CN)

(72) Inventor: Shengyong Cai, Zhejiang (CN)

(73) Assignee: Zhejiang Dongya Facility Co., Ltd., Zhejiang (CN)

( * ) Notice: Subject to any disclaimer, the term of this patent is extended or adjusted under 35 U.S.C. 154(b) by 105 days.

(21) Appl. No.: 17/144,168

(22) Filed: Jan. 8, 2021

(65) Prior Publication Data

US 2022/0219299 A1 Jul. 14, 2022

(51) Int. Cl.
*B25C 1/04* (2006.01)
*B25C 1/00* (2006.01)

(52) U.S. Cl.
CPC ..... *B25C 1/047* (2013.01); *B25C 1/008* (2013.01)

(58) Field of Classification Search
CPC ..... B25C 1/047; B25C 1/008
USPC ..... 227/142
See application file for complete search history.

(56) References Cited

U.S. PATENT DOCUMENTS 5,385,286 A * 1/1995 Johnson, Jr. ..... B25C 1/047 227/8
5,579,977 A * 12/1996 Yang ..... B25C 1/008 227/8
5,685,473 A * 11/1997 Shkolnikov ..... B25C 1/008 227/8
5,785,227 A * 7/1998 Akiba ..... B25C 1/008 227/8
5,921,156 A * 7/1999 Takezaki ..... B25C 1/047 81/433
6,012,622 A * 1/2000 Weinger ..... B25C 1/08 227/8
6,024,267 A * 2/2000 Chen ..... B25C 1/008 227/8
6,170,729 B1 * 1/2001 Lin ..... B25C 1/008 227/8
6,431,429 B1 * 8/2002 Canlas ..... B25C 1/047 227/8
6,763,992 B2 * 7/2004 Hirai ..... B25C 1/008 227/130
6,866,177 B1 * 3/2005 Chen ..... B25C 1/008 227/8
6,883,696 B1 * 4/2005 Steinbrunner ..... B25C 1/008 227/8
10,173,310 B2 * 1/2019 Wyler ..... B25C 1/06
11,229,995 B2 * 1/2022 Gregory ..... B25C 1/00
(Continued)

*Primary Examiner* — Joshua G Kotis
*Assistant Examiner* — Katie L Gerth

(57) ABSTRACT

A nailing depth adjustable air nail gun, including a gun head, a gun body, a clip device, a safety rack installed on the gun head, an adjusting mechanism and a trigger gear, the adjusting mechanism comprises a locating pin and an adjusting screw, the adjusting screw is located at the upper end of locating pin, the bottom of adjusting screw contacts the upper end of locating pin, the adjusting screw comprises a shaft and a head, a regulating wheel, a pressure spring, the pressure spring is fitted over the shaft, the gun head is provided with a limiting base corresponding to the regulating wheel, the limiting base has a strip bulge extending towards the regulating wheel, multiple strip slots matching the strip bulge are uniformly distributed on the outer wall of the regulating wheel, the strip bulge is stuck in the strip slot.

6 Claims, 6 Drawing Sheets

(56) References Cited

U.S. PATENT DOCUMENTS

| | | | | |
|---|---|---|---|---|
| 2003/0080172 | A1* | 5/2003 | Hirai | B25C 1/008 227/142 |
| 2006/0255085 | A1* | 11/2006 | Wen | B25C 1/008 227/8 |
| 2007/0057006 | A1* | 3/2007 | Moore | B25C 1/008 227/8 |
| 2007/0090149 | A1* | 4/2007 | Segura | B25C 1/008 227/8 |
| 2007/0272422 | A1* | 11/2007 | Coleman | B25C 1/06 173/1 |
| 2009/0236386 | A1* | 9/2009 | Wang | B25C 7/00 227/8 |
| 2010/0065603 | A1* | 3/2010 | Liu | B25C 1/008 227/129 |
| 2011/0062207 | A1* | 3/2011 | Hlinka | B25C 1/008 227/8 |
| 2013/0119107 | A1* | 5/2013 | Cheung | B25C 1/188 227/139 |
| 2016/0325420 | A1* | 11/2016 | Krout | B25C 1/008 |
| 2018/0126531 | A1* | 5/2018 | Pomeroy | B25C 1/06 |
| 2020/0398414 | A1* | 12/2020 | Peng | B25C 1/047 |

* cited by examiner

NAILING DEPTH ADJUSTABLE AIR NAIL GUN

BACKGROUND OF INVENTION

1. Field of the Invention

The present invention relates generally to an air nail gun, and more particularly to a nailing depth adjustable air nail gun.

2. Description of Related Art

The pneumatic nail gun is also known as pneumatic nailing machine. The air nail gun uses the high pressure gas generated by the air pump (air compressor) to drive the striker in the nail gun cylinder to perform hammering motion, driving the row nail from the row nail clip into the object or shooting the row nail out.

In nailing operation, different nailing depths are sometimes required in actual operating environment. The existing pneumatic nail gun adjusts the distance from the safety rack end to the gun muzzle by adjusting the adjusting screw, so as to implement the adjustment of nailing depth. However, the pneumatic gun vibrates in operation, the impact force generated by the vibration drives the adjusting screw to rotate, so that the distance from the safety rack end to the gun muzzle deviates, the nailing depth is changed, failing to achieve the intended effect, it shall be adjusted continuously by hand, taking time and labor.

SUMMARY OF THE INVENTION

Considering the insufficient background technology, the problem to be solved by the present invention is to provide a nailing depth adjustable air nail gun, the air nail gun can control the nailing depth accurately, preventing the rotation of adjusting screw from shifting the nailing depth in the course of operation.

The present invention is completed by using the following technical proposal. A nailing depth adjustable air nail gun, including a gun head, a gun body, a clip device, a safety rack installed on the gun head, an adjusting mechanism and a trigger gear. The safety rack end has a circular tube, the circular tube is fitted over the gun muzzle of gun head. The adjusting mechanism comprises a locating pin and an adjusting screw. The locating pin is installed on one side of gun head. The adjusting screw is screwed to the gun body and vertically movable. The adjusting screw is located at the upper end of locating pin. The bottom of adjusting screw contacts the upper end of locating pin. The adjusting screw comprises a shaft and a head. A regulating wheel is fixed to the shaft. A pressure spring is arranged between the regulating wheel and gun body, the pressure spring is fitted over the shaft. The gun head is provided with a limiting base corresponding to the regulating wheel. The limiting base has a strip bulge extending towards the regulating wheel. Multiple strip slots fitting the strip bulge are uniformly distributed on the outer wall of the regulating wheel. The strip bulge is stuck in the strip slot.

In the present invention, the screw is rotated, and then the distance from the circular tube of safety rack to the gun muzzle of gun head is adjusted by the locating pin, so as to adjust the nailing depth of air nail gun. The strip bulge of limiting base is stuck in the strip slot of regulating wheel, preventing the adjusting screw from shifting in the course of operation, the distance between the gun muzzle and safety rack is controlled accurately, preventing the impact force generated in the nailing process rotating the adjusting screw, avoiding the nailing depth shifting in operation, the positioning is more accurate, the operator does not need to make adjustments frequently.

DETAILED DESCRIPTION OF THE INVENTION

The detailed description is given below according to attached figures.

Figure 1:
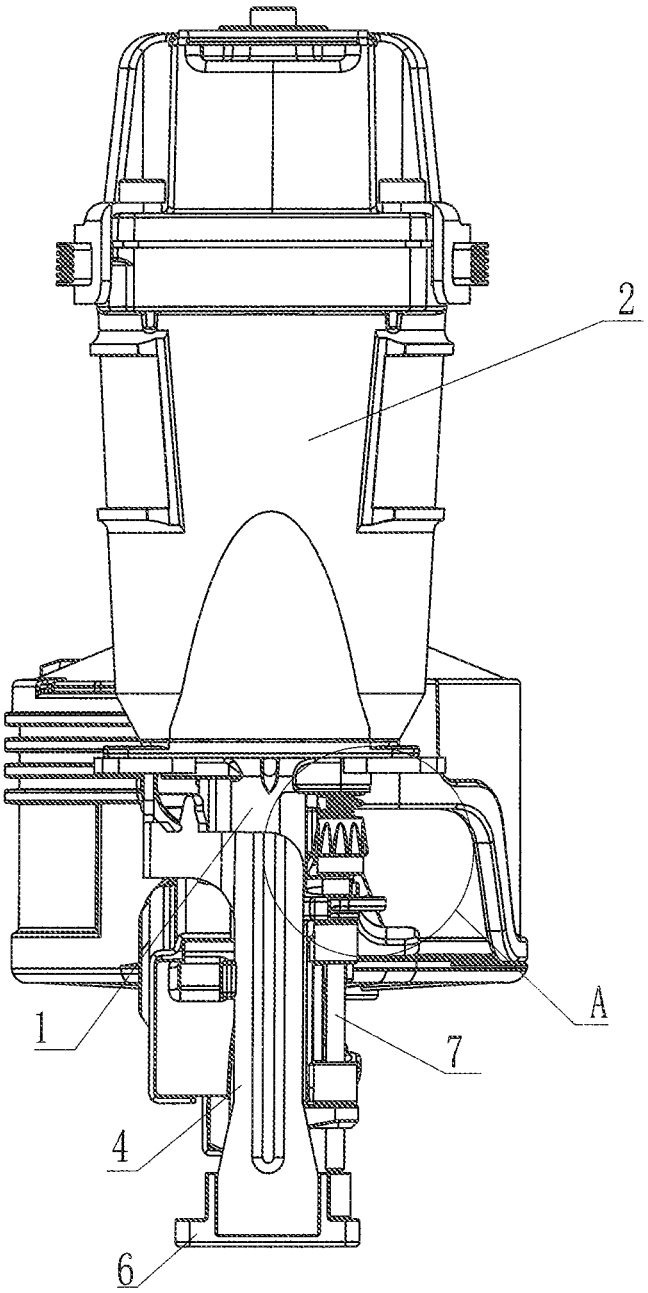
FIG. 1 is a structural representation of a nailing depth adjustable air nail gun in the present invention.
Figure 2:
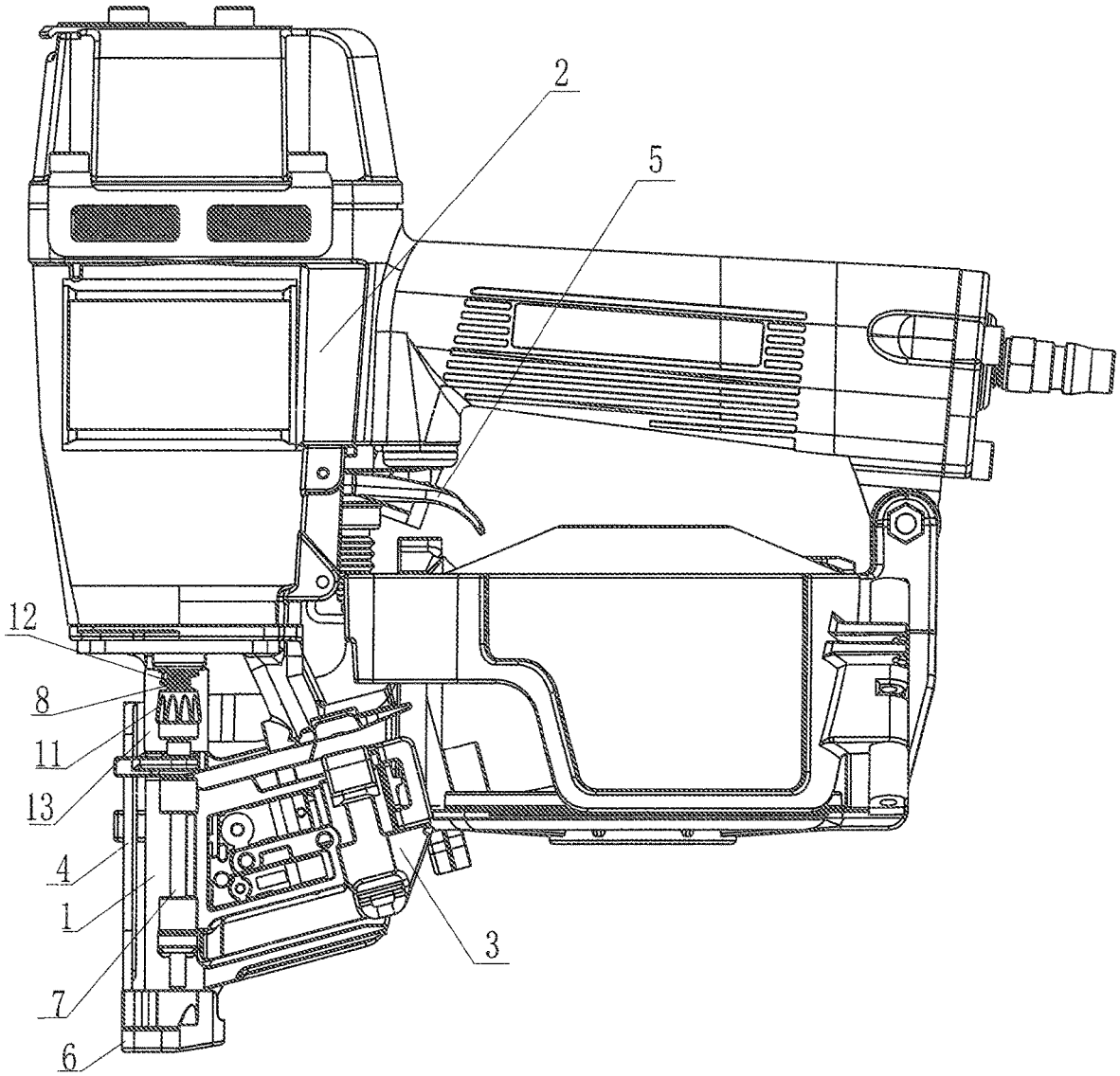
FIG. 2 is a structural representation of another viewing surface of a nailing depth adjustable air nail gun in FIG. 1.
Figure 3:
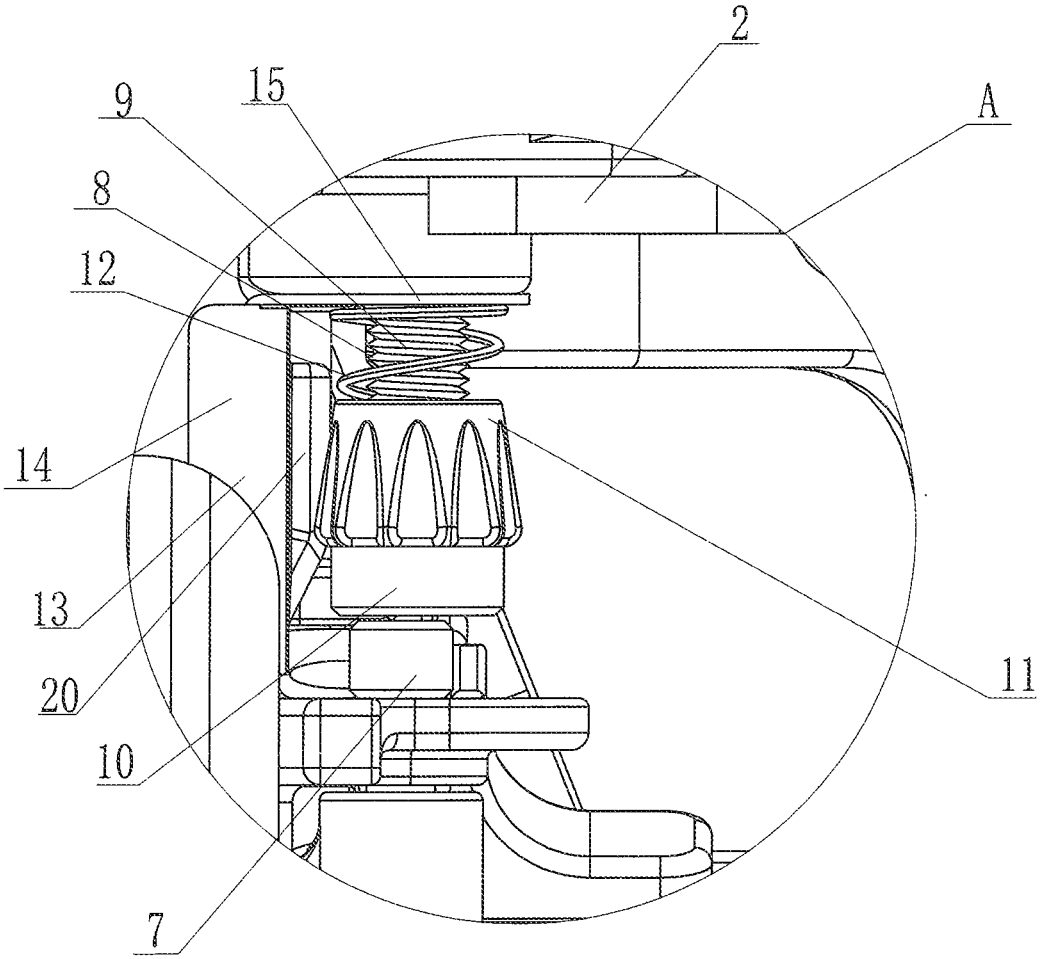
FIG. 3 is a structural representation of Part A of a nailing depth adjustable air nail gun in FIG. 1.
Figure 4:
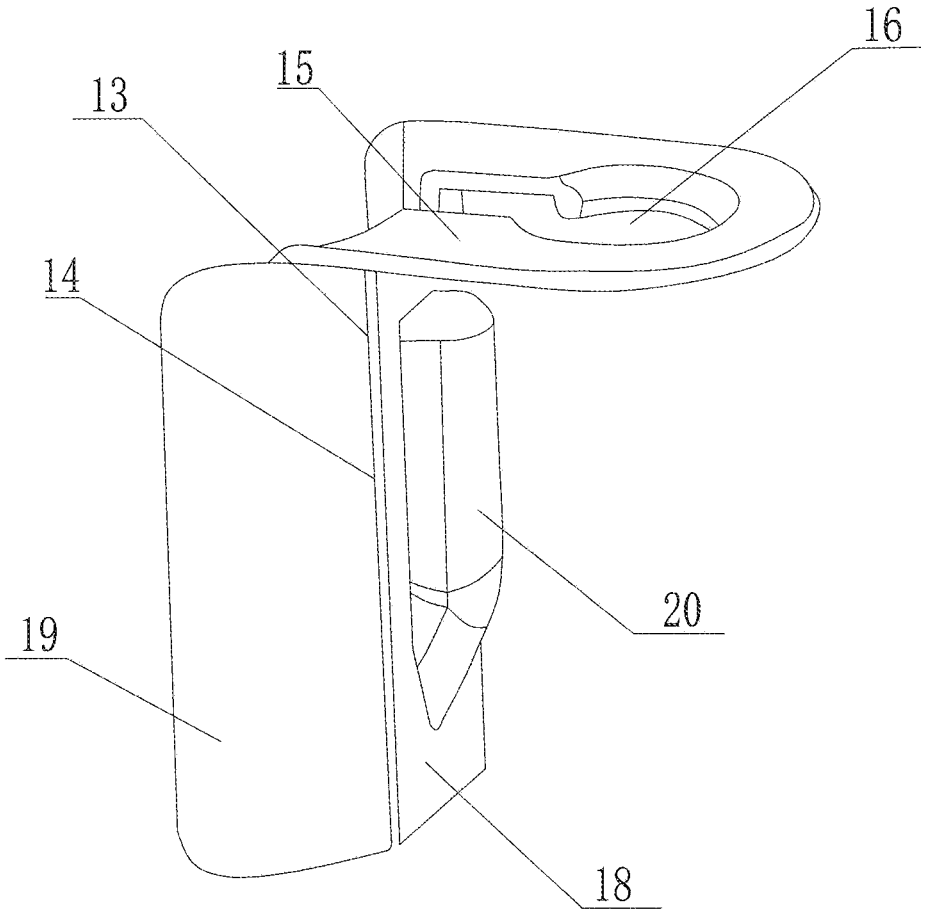
FIG. 4 is a structural representation of limiting base of a nailing depth adjustable air nail gun in FIG. 1.
Figure 5:
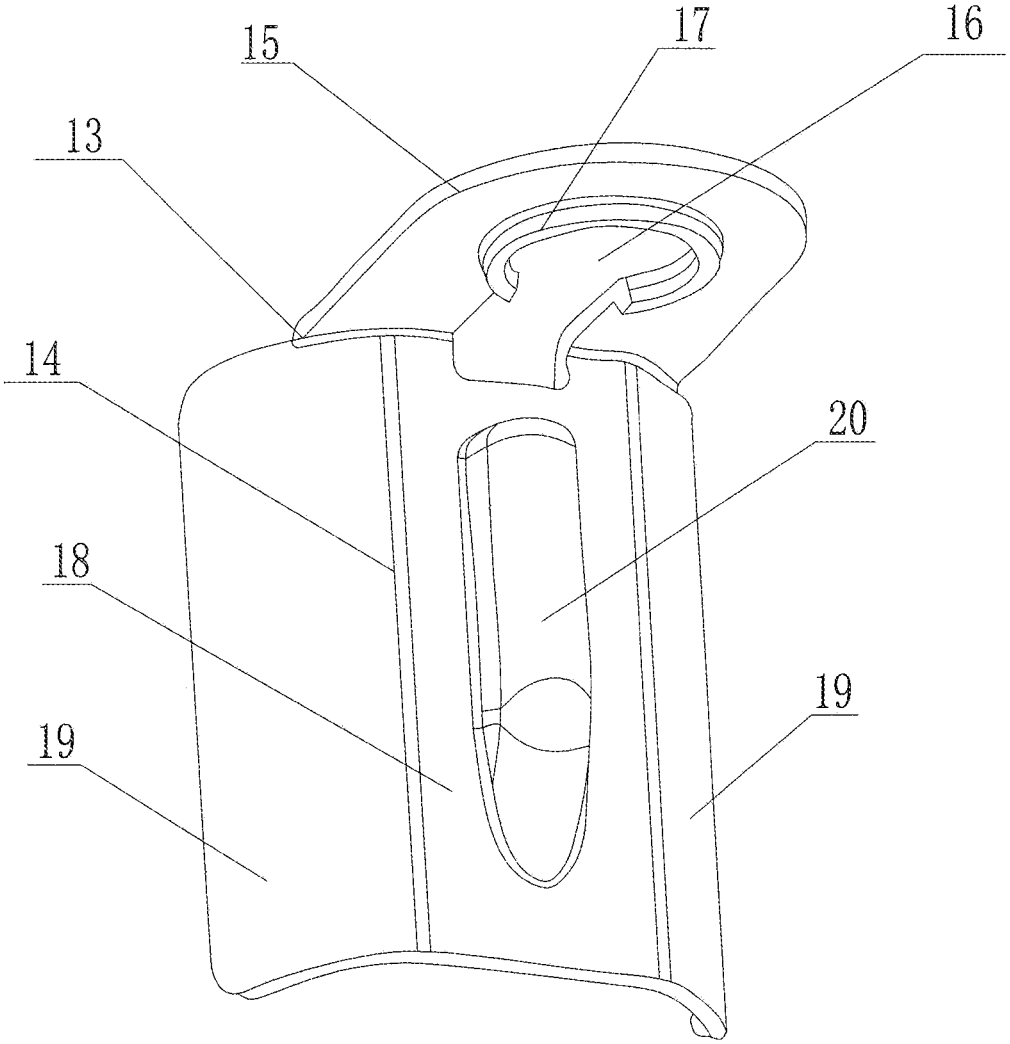
FIG. 5 is a structural representation of another viewing surface of a nailing depth adjustable air nail gun in FIG. 4.
Figure 6:
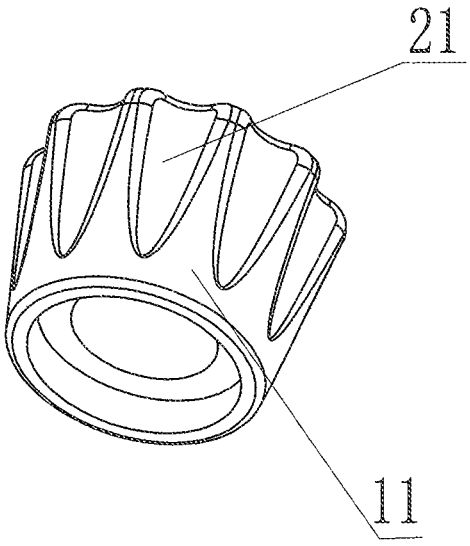
FIG. 6 is a structural representation of regulating wheel of a nailing depth adjustable air nail gun in FIG. 1.

As shown in FIG. 1, FIG. 2, FIG. 3, FIG. 4, FIG. 5 and FIG. 6, the present invention provides a nailing depth adjustable air nail gun, including a gun head 1, a gun body 2, a clip device 3, a safety rack 4 installed on the gun head, an adjusting mechanism and a trigger gear 5. There is a circular tube 6 at the end of the safety rack 4. The circular tube 6 is fitted over the muzzle of gun head 1. The adjusting mechanism comprises a locating pin 7 and an adjusting screw 8. The locating pin 7 is installed on one side of gun head 1. The adjusting screw 8 is screwed to the gun body 2 and vertically movable. The adjusting screw 8 is located at the upper end of locating pin 7. The bottom of adjusting screw 8 contacts the upper end of locating pin 7.

The adjusting screw 8 comprises a shaft 9 and a head 10. The head 10 always props the upper end of locating pin 7. A regulating wheel 11 is fixed to the shaft 9. Elastic material is preferred for the regulating wheel 11. There is a pressure spring 12 between regulating wheel 11 and gun body 2. The pressure spring 12 is fitted over the shaft 9. The gun head 1 is provided with a limiting base 13 corresponding to the regulating wheel 11. The limiting base 13 comprises a vertical part 14 and a horizontal part 15. The vertical part 14 is fixed to the sidewall of gun head 1, and the horizontal part 15 is fixed to the gun body 2. The horizontal part 15 is provided with a through hole 16 corresponding to the adjusting screw. The shaft 9 of adjusting screw is screwed to the gun body 2 through the through hole 16. The lower surface of through hole 16 of the horizontal part has an annular flange 17, the pressure spring 12 is stuck in between horizontal part 15 and regulating wheel 11. The top end of pressure spring 12 is fitted over the annular flange 17. The vertical part comprises a middle part 18 and two side edges 19, the two side edges 19 are arranged on both sides of middle part 18 respectively. The side edge 19 is cambered, the cambered surface of side edge 19 abuts on the lateral surface of gun head 1. The limiting base 13 has a strip bulge 20 extending towards the regulating wheel. The top diameter of the strip bulge 20 is smaller than the bottom width. The top of the strip bulge 20 is a cambered surface. The strip bulge 20 is located in the middle part 18. Multiple strip slots 21 matching the strip bulge 20 are uniformly distributed on the outer wall of the regulating wheel 11. The strip bulge 20 is stuck in the strip slot 21.

The adjusting screw 8 of the pneumatic gun is rotated, and then the distance from the circular tube 6 of safety rack to the muzzle of gun head is adjusted by the locating pin 7, so as to adjust the nailing depth of air nail gun. The strip bulge 20 of limiting base is stuck in the strip slot 21 of regulating wheel, preventing the adjusting screw from shifting in the course of operation, the distance between the muzzle and safety rack is controlled accurately, preventing the impact force generated in the nailing process rotating the adjusting screw, avoiding the nailing depth shifting in operation, the positioning is more accurate, the operator does not need to make adjustments frequently.

I claim:

1. A nailing depth adjustable air nail gun, comprising a gun head, a gun body, a clip device, a safety rack installed on the gun head, an adjusting mechanism and a trigger gear, wherein an end of the safety rack has a circular tube, the circular tube is fitted over the gun head;

the adjusting mechanism includes a locating part and an adjusting screw, and the adjusting screw includes a shaft and a head, the locating part is installed on one side of the gun head, the adjusting screw is threadedly connected to the gun body and can be adjusted up and down to move up and down, the adjusting screw is located at an upper end of the locating part and the head of the adjusting screw is in contact with the upper end of the locating part;

the adjusting screw includes a regulating wheel fixed on the shaft and a pressure spring arranged between the regulating wheel and gun body;

the pressure spring is sleeved on the shaft, the gun head is provided with a limiting base corresponding to the regulating wheel, the limiting base has a strip bulge extending in a direction of the regulating wheel, and an outer wall of the regulating wheel is evenly distributed with a plurality of strip slots that are adapted to the strip bulge.

2. The nailing depth adjustable air nail gun according to claim 1, wherein the limiting base includes a vertical part and a horizontal part, the vertical part is fixed to a sidewall of the gun head, and the horizontal part is fixed to the gun body, the horizontal part is provided with a through hole corresponding to the adjusting screw, the shaft of the adjusting screw is screwed to the gun body through the through hole.

3. The nailing depth adjustable air nail gun according to claim 2, wherein the vertical part includes a middle part and two side edges, the two side edges are arranged on both sides of the middle part respectively, the strip bulge is located in the middle part, the side edge is a cambered surface, the cambered surface of the side edge abuts on the lateral surface of the gun head.

4. The nailing depth adjustable air nail gun according to claim 2, wherein a lower surface of the through hole of the horizontal part has an annular flange, the pressure spring is stuck in between the horizontal part and the regulating wheel, a top end of the pressure spring is fitted over the annular flange.

5. The nailing depth adjustable air nail gun according to claim 4, wherein the top diameter of the strip bulge is smaller than bottom width, the top of the strip bulge is a cambered surface.

6. The nailing depth adjustable air nail gun according to claim 1, wherein the regulating wheel is made of elastic material.

* * * * *